US008068763B2

(12) United States Patent
Hashimoto

(10) Patent No.: US 8,068,763 B2
(45) Date of Patent: Nov. 29, 2011

(54) TANDEM TYPE PHOTOSENSITIVE UNIT AND IMAGE FORMING APPARATUS

(75) Inventor: Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 281 days.

(21) Appl. No.: 12/412,205

(22) Filed: Mar. 26, 2009

(65) Prior Publication Data

US 2009/0324280 A1 Dec. 31, 2009

(30) Foreign Application Priority Data

Jun. 27, 2008 (JP) ..... 2008-168154

(51) Int. Cl.
*G03G 21/16* (2006.01)
*G03G 15/00* (2006.01)

(52) U.S. Cl. ..... 399/111; 399/117

(58) Field of Classification Search ..... 399/111, 399/113, 119, 116, 117
See application file for complete search history.

(56) References Cited

U.S. PATENT DOCUMENTS

| | | | | |
|---|---|---|---|---|
| 2005/0147432 | A1 | 7/2005 | Miura et al. | |
| 2007/0036582 | A1 | 2/2007 | Okabe | |
| 2007/0077087 | A1* | 4/2007 | Okabe et al. | 399/111 |
| 2007/0160380 | A1 | 7/2007 | Imaizumi et al. | |

FOREIGN PATENT DOCUMENTS

| | | |
|---|---|---|
| JP | 08-054817 | 2/1996 |
| JP | 2003-316233 | 11/2003 |
| JP | 2004-070088 | 3/2004 |
| JP | 2007-072422 | 3/2007 |
| JP | 2007-213018 | 8/2007 |

OTHER PUBLICATIONS

Notice of Reasons of Refusal for Japanese Application No. 2008-168154 mailed on Apr. 27, 2010.

* cited by examiner

*Primary Examiner* — David Porta
*Assistant Examiner* — Faye Boosalis
(74) *Attorney, Agent, or Firm* — Banner & Witcoff, Ltd.

(57) ABSTRACT

A tandem type photosensitive unit includes a plurality of drum retaining units arrayed in line in an arraying direction, and a pair of side plates arranged on both sides of the drum retaining units in an axial direction perpendicular to the arraying direction and collectively opposed to the drum retaining units. Each drum retaining unit retains a photosensitive drum having an axis which extends in the axial direction. At least one of the side plates is provided to be slidable in the axial direction.

18 Claims, 6 Drawing Sheets

TANDEM TYPE PHOTOSENSITIVE UNIT AND IMAGE FORMING APPARATUS

CROSS REFERENCE TO RELATED APPLICATION

This application claims priority to Japanese Patent Application No. 2008-168154 filed on Jun. 27, 2008, the disclosure of which is hereby incorporated into the present application by reference.

TECHNICAL FIELD

The present invention relates to an image forming apparatus such as a color printer and a tandem type photosensitive unit mounted thereon.

BACKGROUND

In relation to an electrophotographic color printer, the so-called tandem type color printer having parallelly arranged photosensitive drums corresponding to yellow, magenta, cyan and black respectively is in the process of forming the mainstream.

Tandem type color printers include that having a tandem type photosensitive unit formed by collectively retaining four photosensitive drums with a pair of side plates and detachably mounted on a main body casing.

The photosensitive drums include cylindrical drum bodies and drum shafts arranged along the axial directions of the drum bodies. The pair of side plates are fixed to beams provided on both sides in a direction orthogonal to the opposed direction thereof (a direction orthogonal to the drum shafts) respectively. Four shaft holes are formed in each side plate at regular intervals in the arrangement direction of the photosensitive drums. Both end portions of the drum shafts of the photosensitive drums are inserted into the shaft holes of the side plates respectively, so that the four photosensitive drums are positioned to be precisely arranged at a constant pitch.

The black photosensitive drum is more frequently used as compared with the remaining three photosensitive drums, and hence has a short life. Further, the drum body of any photosensitive drum may be damaged, depending on handling of the tandem type photosensitive unit. In order to ensure excellent image quality, the photosensitive drum must be exchanged for a new one when the same is used up or the drum body thereof is damaged.

In the structure of the aforementioned color printer, however, the drum shaft of each photosensitive drum is inserted into the shaft holes of the side plates. If any photosensitive drum must be exchanged for a new one, therefore, this photosensitive drum cannot be detached from the pair of side plates in the state fixed to both beams. In this case, therefore, at least one of the side plates must be dismounted (detached) from both beams for exchanging the photosensitive drum for a new one and the drum shafts of all photosensitive drums must be thereafter inserted into the shaft holes of the side plate, which in turn must be fixed to the beams again. Thus, the operation for exchanging the photosensitive drum is time-consuming.

SUMMARY

One aspect of the present invention may provide a tandem type photosensitive unit and an image forming apparatus capable of individually detaching a plurality of photosensitive drums from a pair of side plates without dismounting the side plates from other members.

The same or different aspect of the present invention may provide a tandem type photosensitive unit detachably mounted on an apparatus body of an image forming apparatus. The tandem type photosensitive unit includes a plurality of drum retaining units arrayed in line in an arraying direction, and a pair of side plates arranged on both sides of the drum retaining units in an axial direction perpendicular to the arraying direction and collectively opposed to the drum retaining units. Each drum retaining unit retains a photosensitive drum having an axis which extends in the axial direction. At least one of the side plates is provided to be slidable in the axial direction.

The same or different aspect of the present invention may provide an image forming apparatus including an apparatus body and a tandem type photosensitive unit detachably mounted on the apparatus body. The tandem type photosensitive unit includes a plurality of drum retaining units arrayed in line in an arraying direction, and a pair of side plates arranged on both sides of the drum retaining units in an axial direction perpendicular to the arraying direction and collectively opposed to the drum retaining units. Each drum retaining unit retains a photosensitive drum having an axis which extends in the axial direction The interval between the side plates in a state where the tandem type photosensitive unit is detached from the apparatus body is greater than the interval between the side plates in a state where the tandem type photosensitive unit is mounted on the apparatus body.

DETAILED DESCRIPTION

An embodiment of the present invention is now described with reference to the drawings.

A. Overall Structure of Color Printer

Figure 1:
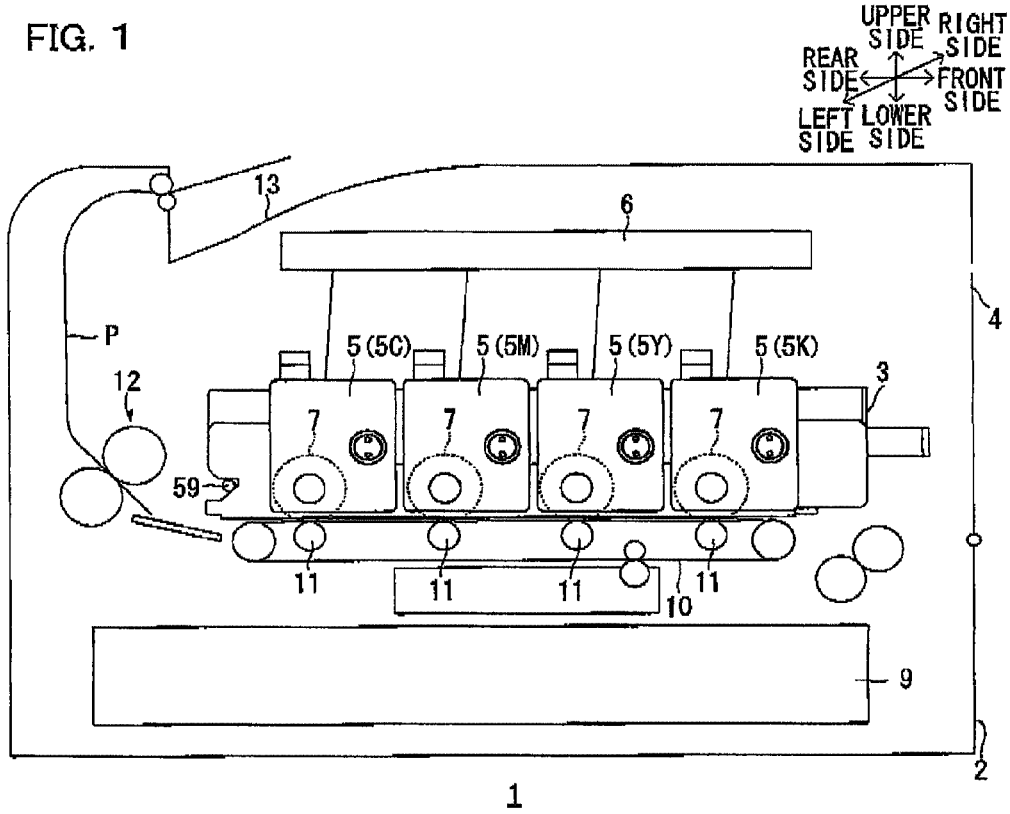
FIG. 1 is a side sectional view of a color printer according to an embodiment of the present invention.

FIG. 1 is a side sectional view of a color printer according to the embodiment of the present invention.

This color printer 1 as an example of an image forming apparatus is a tandem type color printer. A tandem type photosensitive unit 3 is mounted in a main body casing 2 as an example of an apparatus body. This tandem type photosensitive unit 3 is detachably mountable in the main body casing 2 by opening a cover 4 provided on one side surface of the main body casing 2.

In the following description, it is assumed that the side (the right side in FIG. 1) provided with the cover 4 is the front side, and the opposite side (the left side in FIG. 1) is the rear side (the back side). The right and left direction is defined with reference to the color printer 1 as viewed from the front side. The right and left direction is hereinafter referred to as a width direction. The tandem type photosensitive unit 3 is described with reference to directions in the state mounted in the main body casing 2, unless otherwise stated.

Process cartridges 5 as examples of four drum retaining units are anteroposteriorly parallelly arranged in the tandem type photosensitive unit 3. The process cartridges 5 (5K, 5Y, 5M and 5C) are provided correspondingly to black, yellow, magenta and cyan respectively, and arranged at regular intervals from the front side in this order.

An exposure unit 6 emitting four laser beams corresponding to the colors respectively is arranged above the tandem type photosensitive unit 3. Alternatively, four LED arrays may be provided correspondingly to the process cartridges 5 respectively, in place of the exposure unit 6.

Each process cartridge 5 includes a photosensitive drum 7. Following rotation of the photosensitive drum 7, the surface of the photosensitive drum 7 is uniformly charged, and thereafter selectively exposed by the corresponding laser beam from the exposure unit 6. An electrostatic latent image is formed on the surface of the photosensitive drum 7 due to this exposure When the electrostatic latent image is opposed to a developing roller (not shown) following the rotation of the photosensitive drum 7, a toner is fed to the electrostatic latent image, and a toner image is formed on the surface of the photosensitive drum 7.

A sheet feeding cassette 9 accommodating sheets P is arranged on the bottom portion of the main body casing 2. Each sheet P accommodated in the sheet feeding cassette 9 is transported onto a transport belt 10 by various rollers. The transport belt 10 is opposed to the four photosensitive drums 7 from below. A transfer roller 11 is arranged on each position opposed to each photosensitive drum 7 through an upper portion of the transport belt 10. The sheet P transported onto the transport belt 10 successively passes through the spaces between the transport belt 10 and the photosensitive drums 7 due to the traveling of the transport belt 10. When opposed to the sheet P, the toner image formed on the surface of each photosensitive drum 7 is transferred to the sheet P by a transfer bias applied to the transfer roller 11.

A fuser 12 is provided on a downstream side of the transport belt 10 in the transport direction for the sheet P. The sheet P having the transferred toner image is transported to the fuser 12. The fuser 12 fixes the toner image to the sheet P by heating and pressurization. The sheet P having the fixed toner image is ejected to a sheet ejecting tray 13 provided on the upper surface of the main body casing 2 by various rollers.

B. Tandem Type Photosensitive Unit

Figure 2:
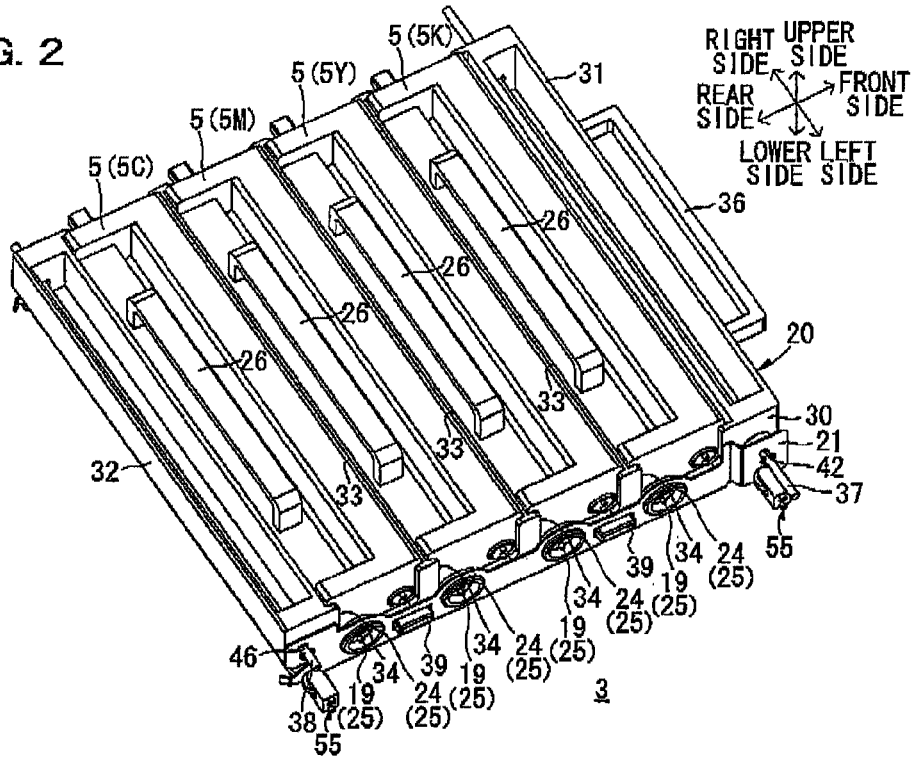
FIG. 2 is a perspective view of a tandem type photosensitive unit as viewed from above the left rear side, in a state mounted in a main body casing.
Figure 3:
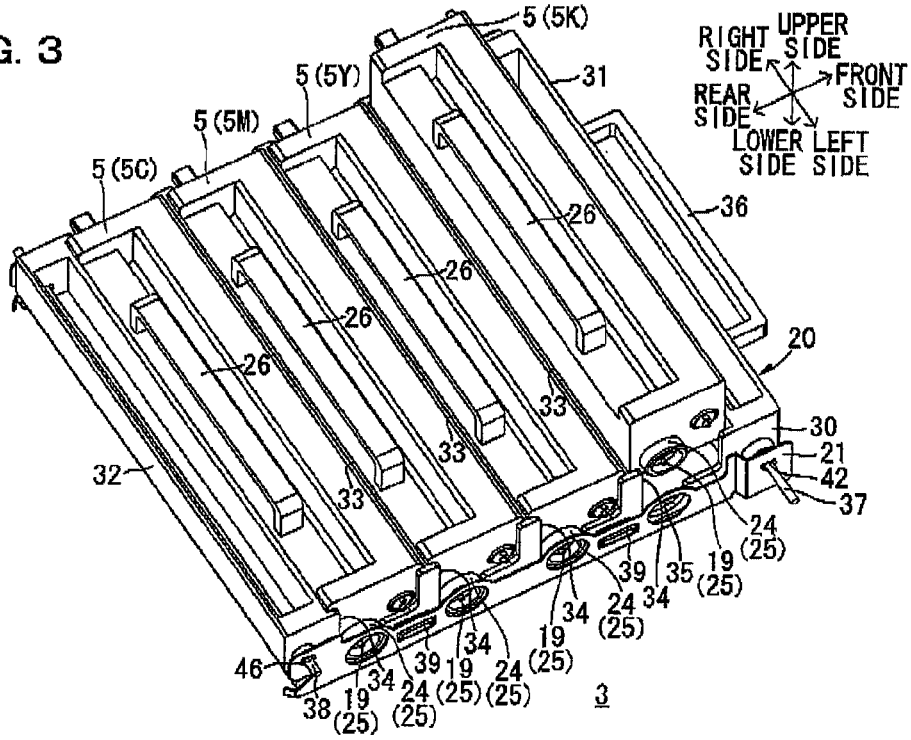
FIG. 3 is a perspective view of the tandem type photosensitive unit as viewed from above the left rear side, in a state detached from the main body casing.
Figure 4:
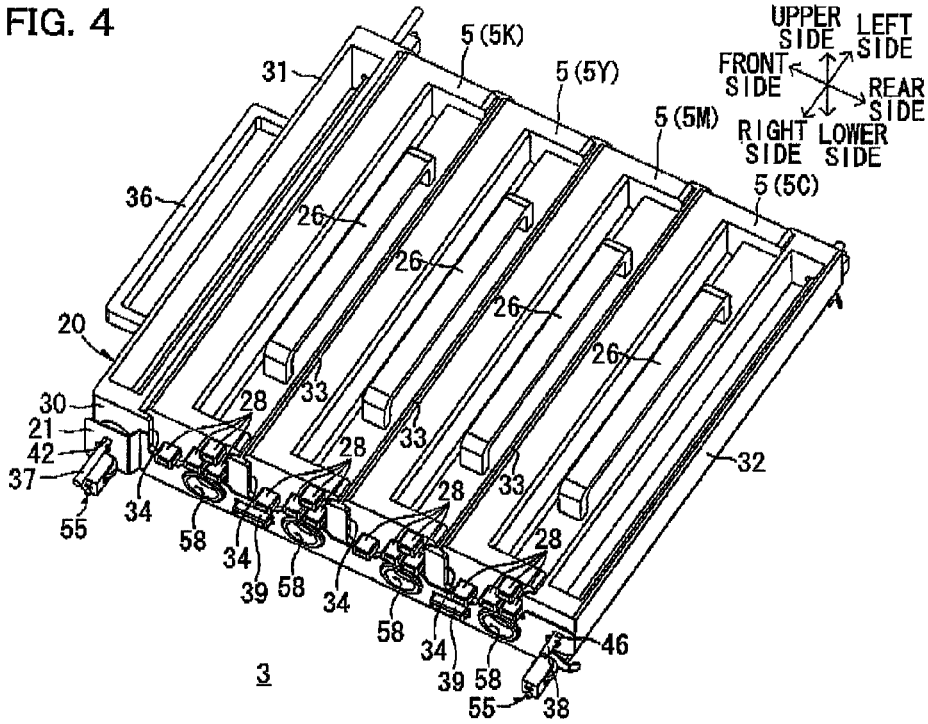
FIG. 4 is a perspective view of the tandem type photosensitive unit as viewed from above the right rear side, in the state mounted in the main body casing.
Figure 5:
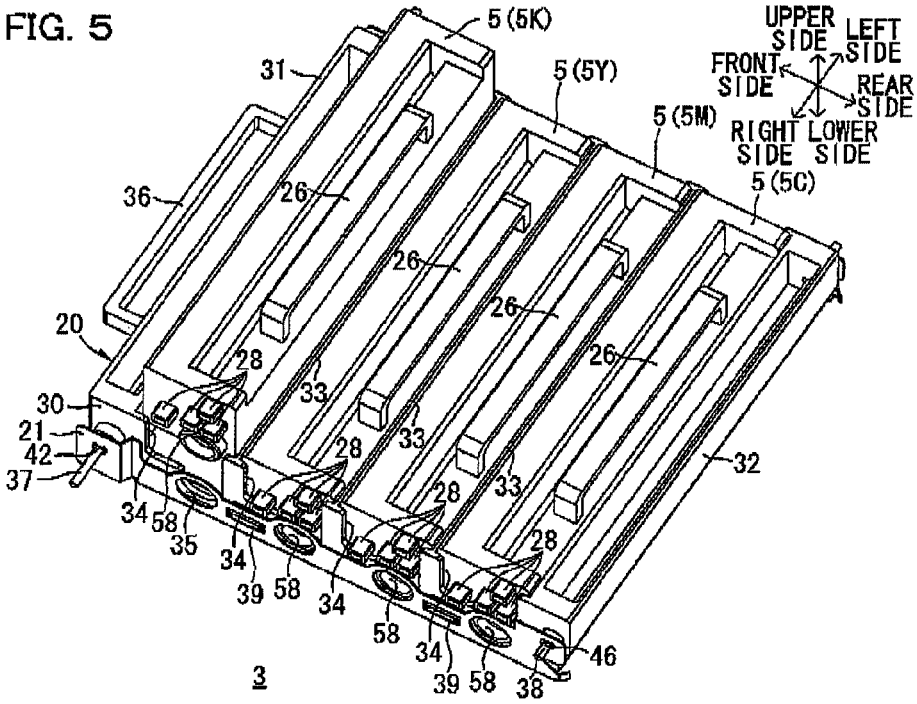
FIG. 5 is a perspective view of the tandem type photosensitive unit as viewed from above the right rear side, in the state detached from the main body casing.
Figure 6:
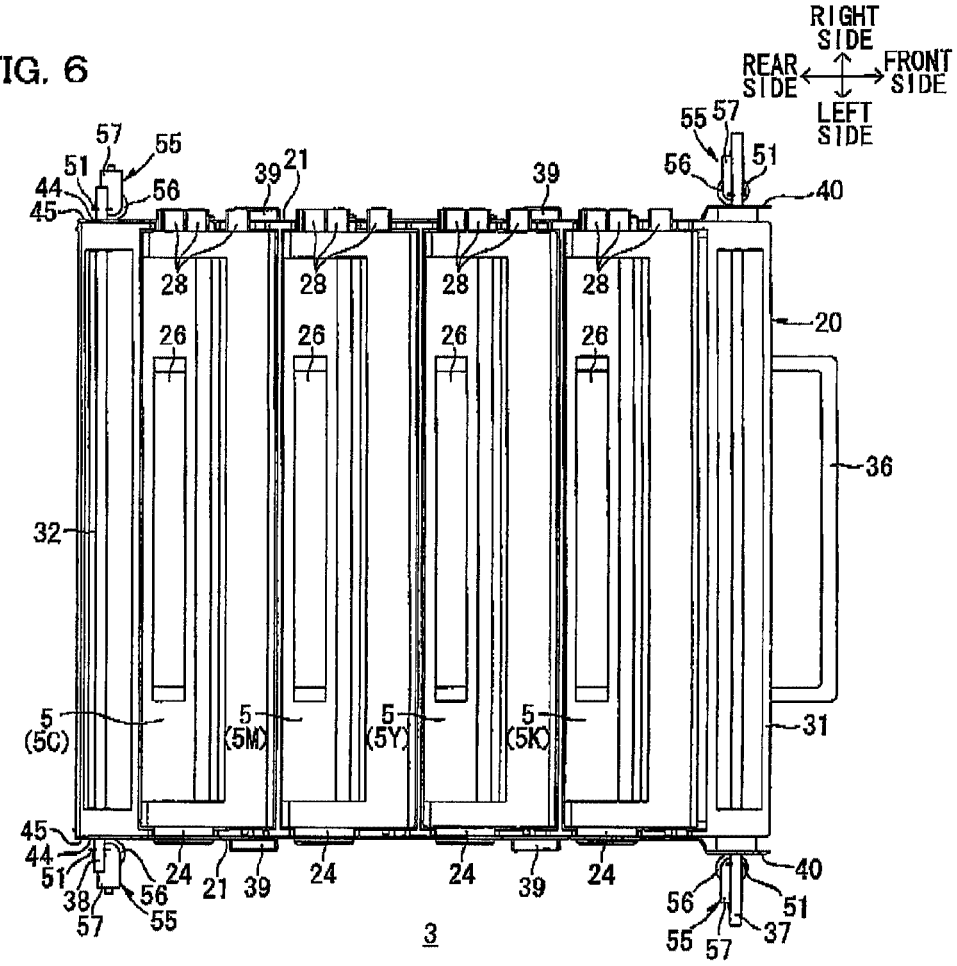
FIG. 6 is a plan view of the tandem type photosensitive unit, in the state mounted in the main body casing.
Figure 7:
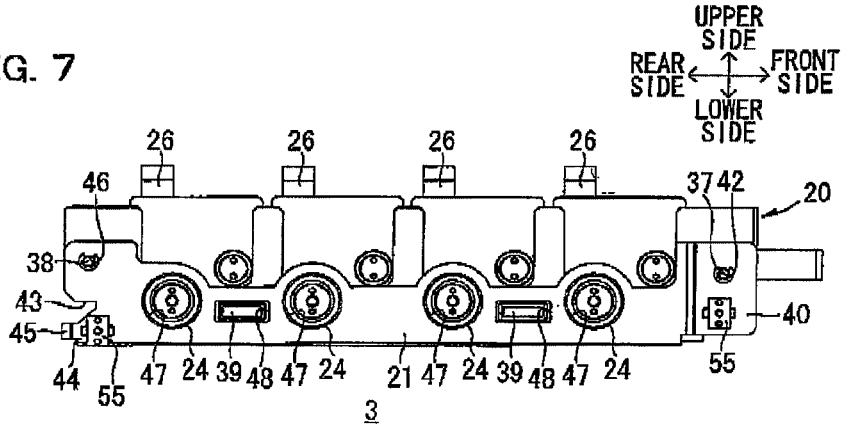
FIG. 7 is a left side elevational view of the tandem type photosensitive unit, in the state mounted in the main body casing.

FIG. 2 is a perspective view of the tandem type photosensitive unit as viewed from above the left rear side, in a state mounted in the main body casing. FIG. 3 is a perspective view of the tandem type photosensitive unit as viewed from above the left rear side, in a state detached from the main body casing. FIG. 4 is a perspective view of the tandem type photosensitive unit as viewed from above the right rear side, in the state mounted in the main body casing. FIG. 5 is a perspective view of the tandem type photosensitive unit as viewed from above the right rear side, in the state detached from the main body casing. FIG. 6 is a plan view of the tandem type photosensitive unit, in the state mounted in the main body casing. FIG. 7 is a left side elevational view of the tandem type photosensitive unit, in the state mounted in the main body casing.

B-1. Process Cartridge

Each process cartridge 5 is generally in the form of a rectangular parallelepiped elongated in the width direction. In the process cartridge 5, the photosensitive drum 7 and the developing roller (not shown) are arranged, and the toner corresponding to each color is accommodated. An opening is formed in the lower surface of the process cartridge 5 (casing), and the photosensitive drum 7 is so arranged that the peripheral surface thereof is partially exposed from this opening.

As shown in FIGS. 2 and 3, a driving force input portion 25 for inputting driving force into the photosensitive drum 7 is provided on the left sidewall of the process cartridge 5 on the axis of the photosensitive drum 7. The driving force input portion 25 includes a cylindrical coupling cover 24 projecting from the left sidewall of the process cartridge 5 and an input gear 19 surrounded by the coupling cover 24. The coupling cover 24 is so formed that the central axis thereof coincides with the axis of the photosensitive drum 7.

In the state where the tandem type photosensitive unit 3 is mounted in the main body casing 2, a driving force transmission mechanism (not shown) provided in the main body casing 2 is connected to the driving force input portion 25. The driving force is input from the driving force transmission mechanism into the driving force input portion 25, and the photosensitive drum 7 is rotated by this driving force.

As shown in FIGS. 4 and 5, a drum support member 58 engaging with the right end portion of the photosensitive drum 7 for relatively rotatably supporting the photosensitive drum 7 is provided on the right sidewall of each process cartridge 5. The drum support member 58 is in the form of a cylinder identically to the coupling cover 24 (see FIGS. 2 and 3), and projects from the right sidewall of the process cartridge 5.

A plurality of electrodes 28 are arranged on the right sidewall of the process cartridge 5. A main-body-side electrode (not shown) provided in the main body casing 2 is connected to each electrode 28, in order to feed power to the process cartridge 5.

A cartridge grasp portion 26 is formed on the upper surface of the process cartridge 5.

B-2. Unit Support Frame

The tandem type photosensitive unit 3 includes a unit support frame 20 collectively supporting the four process cartridges 5 from below and a pair of side plates 21 provided on both sides of the process cartridges 5 in the width direction.

The unit support frame 20 integrally includes a horizontal pair of unit side plates 30, a front beam 31 and a rear beam 32, and is in the form of a frame surrounding the peripheries of the four process cartridges 5. The unit support frame 20 is made of resin.

Each unit side plate 30 is opposed to the four process cartridges 5 in the width direction. In the unit side plate 30, notched portions 34 are formed on positions opposed to the process cartridges 5 respectively by notching the unit side plate 30 from the upper end thereof. Support grooves 35 generally arcuate in side elevational view are formed in the lower end portions of the notched portions 34 respectively. In other words, the unit side plate 30 is provided with the four support grooves 35 generally arcuate in side elevational view having open upper portions. The four support grooves 35 are formed at regular intervals in the anteroposterior direction.

When the process cartridges 5 are mounted on the tandem type photosensitive unit 3, the support grooves 35 of the left unit side plate 30 receive the coupling covers 24, and support the coupling covers 24 from below. When the process cartridges 5 are mounted on the tandem type photosensitive unit 3, further, the support grooves 35 of the right unit side plate 30 receive the drum support members 58, and support the drum support members 58 from below.

Two support projections 39 are formed on an intermediate portion of each unit side plate 30 in the anteroposterior direction at an interval in the anteroposterior direction. Each support projection 39 projects outward from the outer side surface of each unit side plate 30.

The front beam 31 has a generally U-shaped form extending in the width direction in plan view, and is extended between the front end portions of the unit side plates 30. The front beam 31 retains a first guide shaft 37 as an example of a guide shaft. The first guide shaft 37 passes through the front beam 31 over the width direction, and both end portions thereof project outward from the front beam 31 in the width direction. A unit grasp portion 36 is integrally formed on the front surface of the front beam 31.

The rear beam 32 has a generally U-shaped form extending in the width direction in plan view, and is extended between the rear end portions of the unit side plates 30. The rear beam 32 retains a second guide shaft 38 as an example of the guide shaft. The second guide shaft 38 passes through the rear beam 32 over the width direction, and projects outward from the rear beam 32 in the width direction.

Three partition plates 33 are formed between the left and right unit side plates 30. The partition plates 33 extend in the width direction and the vertical direction, and both end portions thereof in the width direction are connected between the notched portions 34 adjacent to one another in the unit side plates 30. Thus, the space surrounded by the front beam 31, the rear beam 32 and the pair of unit side plates 30 is anteroposteriorly partitioned into four portions by the three partition plates 33.

B-3. Side Plate

The left and right side plates 21 are formed by punching and pressing metal plates. Each side plate 21 is generally in the form of a rectangle elongated in the anteroposterior direction in side elevational view, and the front end portion and the rear end portion thereof are opposed to the front beam 31 and the rear beam 32 in the width direction respectively.

The front end portion of the side plate 21 is cranked to form an upstream pressured portion 40 projecting outward beyond the rear end portion of the side plate 21 in the width direction.

A first guide shaft hole 42 is formed in the upper end portion of the upstream pressured portion 40. The first guide shaft 37 is inserted into the first guide shaft hole 42. A stopper ring 51 is fixed to a portion of the first guide shaft 37 projecting outward from the side plate 21 in the width direction.

A receiving portion 43 is formed on the rear end portion of the side plate 21 by being notched from the rear edge thereof in a generally V-shaped manner. A main body reference shaft 59 (see FIG. 1) extending in the width direction is provided on the rear end portion in the main body casing 2 correspondingly to the receiving portion 43.

A portion of the rear end portion of the side plate 21 under the receiving portion 43 forms a downstream pressured portion 44.

A second guide shaft hole 46 is formed in a portion of the rear end portion of the side plate 21 above the receiving portion 43. The second guide shaft 38 is inserted into the second guide shaft hole 46. A stopper ring 51 is fixed to a portion of the second guide shaft 38 projecting outward from the side plate 21 in the width direction.

In the side plate 21, circular drum retaining holes 47 as examples of positioning portions are formed on positions opposed to the support grooves 35 of the unit side plate 30 respectively. The coupling covers 24 of the process cartridges 5 engage with the drum retaining holes 47 of the left side plate 21 respectively. On the other hand, the drum support members 58 of the process cartridges 5 engage with the drum retaining holes 47 of the right side plate 21 respectively.

Each side plate 21 is provided with square holes 48 engaging with the support projections 39 of the unit support frame 20 respectively. The support projections 39 engage with the square holes 48 to guide sliding movement of the side plate 21 in an auxiliary manner, and prevent the anteroposterior central portion of the side plate 21 from deflection.

B-4. Urging Member

The tandem type photosensitive unit 3 includes four coil springs 50 as examples of an urging member urging the side plates 21 outward in the width direction.

Two of the coil springs 50 are inserted into the first guide shaft 37, and arranged between the side plates 21 and the unit side plates 30 opposed thereto in compressed states. The remaining two coil springs 50 are inserted into the second guide shaft 38, and arranged between the side plates 21 and the unit side plate 30 opposed thereto in compressed states. Thus, each side plate 21 is urged in a direction (outward in the width direction) separating from the corresponding unit side plate 30 due to the urging force of the front and rear coil springs 50.

C. Pressing Member

As shown in FIGS. 2 and 4, four pressing members 55 are provided in the main body casing 2. The pressing members 55 include discoidal rollers 56 having vertically extending axes and retaining portions 57 relatively rotatably retaining the rollers 56. When the tandem type photosensitive unit 3 is mounted in the main body casing 2, the four pressing members 55 are arranged on positions where the rollers 56 come into contact with the upstream pressed portion 40 and the downstream pressed portion 44 of each side plate 21. The retaining portions 57 are fixed to main body side plates (not shown) of the main body casing 2.

D. Operation of Attaching/Detaching Tandem Type Photosensitive Unit

Figure 8:
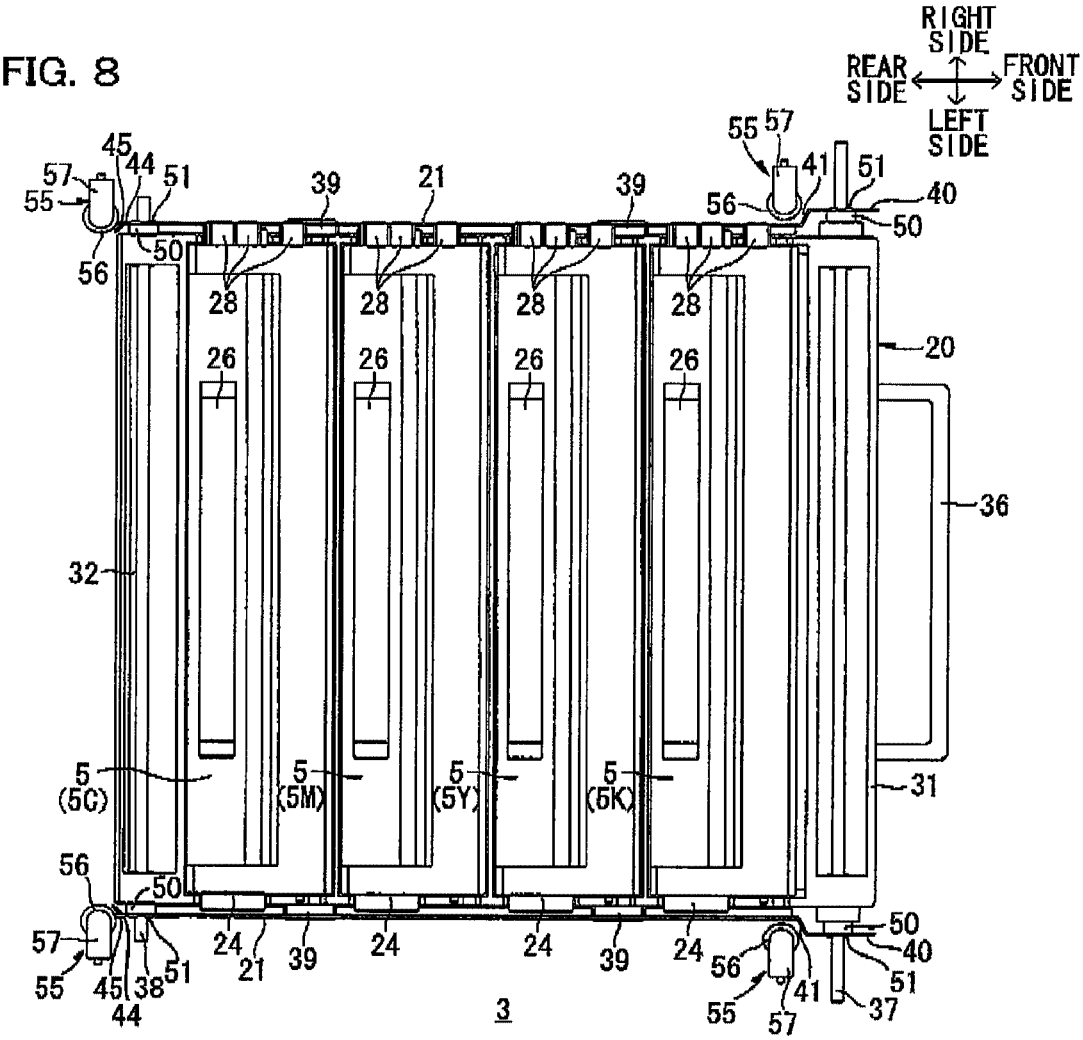
FIG. 8 is a plan view of the tandem type photosensitive unit, in the process of attachment to/detachment from the main body casing.
Figure 9:
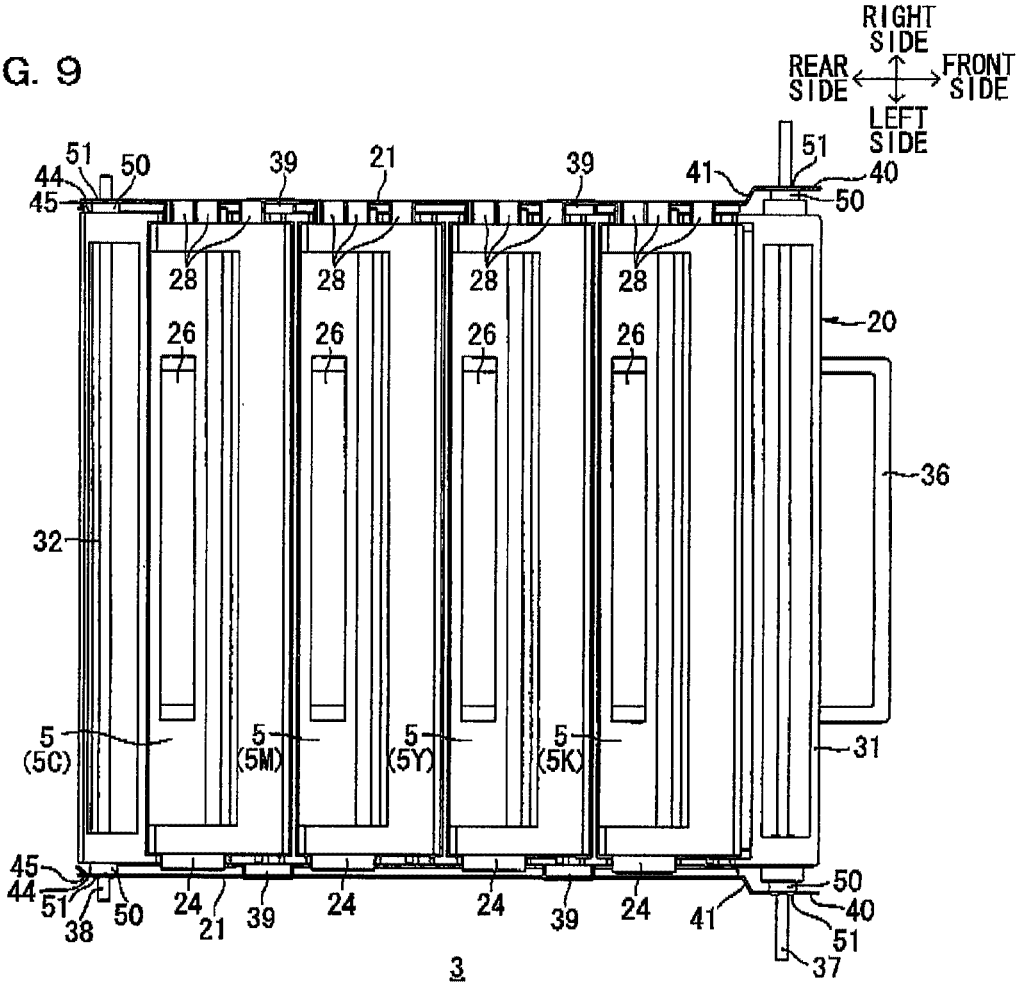
FIG. 9 is a plan view of the tandem type photosensitive unit, in the state detached from the main body casing.

FIG. 8 is a plan view of the tandem type photosensitive unit, in the process of attachment to/detachment from the main body casing. FIG. 9 is a plan view of the tandem type photosensitive unit, in the state detached from the main body casing.

When the tandem type photosensitive unit 3 is mounted in the main body casing 2, the pressing members 55 are in contact with the upstream pressed portions 40 and the downstream pressed portions 44 to press the upstream pressed portions 40 and the downstream pressed portions 44 inward in the width direction against the urging force of the coil springs 50, as shown in FIG. 6. Each side plate 21 is arranged on a contact position in contact with each process cartridge 5 due to this pressing.

In this state, the coupling cover 24 of the process cartridge 5 engages with each drum retaining hole 47 of the left side plate 21 and the drum support member 58 of the process cartridge 5 engages with each drum retaining hole 47 of the right side plate 21, to position the process cartridge 5. The main body reference shaft 59 (see FIG. 1) is received in the receiving portion 43 of each side plate 21.

When the tandem type photosensitive unit 3 is moved frontward from this state, the pressing members 55 are displaced from the upstream pressured portions 40 and the downstream pressured portions 44 and released from the states where the pressing members 55 press the side plates 21, as shown in FIG. 8. Therefore, each side plate 21 is guided by the first guide shaft 37 and the second guide shaft 38 to move outward in the width direction due to the urging force of the coil springs 50.

When the tandem type photosensitive unit 3 is detached from the main body casing 2, each side plate 21 comes into contact with the stopper rings 51, and is arranged on a separate position separating from each process cartridge 5, as shown in FIG. 9. In other words, the outward movement of the side plate 21 in the width direction is regulated when the side plate 21 comes into contact with the stopper rings 51, and the side plate 21 is arranged on the separate position due to this regulation.

When the side plate 21 is arranged on the separate position, the coupling cover 24 and the drum support member 58 of each process cartridge 5 are detached from each drum retaining hole 47 of the side plate 21. At this time, the coupling cover 24 and the drum support member 58 of the process cartridge 5 are received in the support grooves 35 of the unit support frame 20 and supported from below. Therefore, each process cartridge 5 can be independently displaced from the tandem type photosensitive unit 3 upward, and mounted on the tandem type photosensitive unit 3 (unit support frame 20) from above. When the process cartridge 5 is mounted on the unit support frame 20, the coupling cover 24 and the drum support member 58 of the process cartridge 5 are fitted into the left and right support grooves 35 respectively The tandem type photosensitive unit 3 can be mounted in the main body casing 2 by pushing the tandem type photosensitive unit 3 into the main body casing 2 from the state shown in FIG. 9. When the movement of the tandem type photosensitive unit 3 progresses, the pressing members 55 come into contact with the upstream pressed portion 40 and the downstream pressed portion 44, to press the upstream pressed portion 40 and the downstream pressed portion 44 inward in the width direction against the urging force of the coil springs 50. Thus, each side plate 21 is moved inward in the width direction, the coupling cover 24 of the process cartridge 5 is inserted into each drum retaining hole 47 of the left side plate 21 and the drum support member 58 of the process cartridge 5 is inserted into each drum retaining hole 47 of the right side plate 21, so that the process cartridge 5 is positioned with respect to the tandem type photosensitive unit 3. When the receiving portion 43 of each side plate 21 comes into contact with the main body reference shaft 59 (see FIG. 1), further pushing of the tandem type photosensitive unit 3 is regulated. Thus, the tandem type photosensitive unit 3 is completely mounted in the main body casing 2.

E. Functions/Effects

As hereinabove described, the tandem type photosensitive unit 3 includes the four process cartridges 5. The four process cartridges 5 retain the photosensitive drums 7 respectively, and are parallelly arranged in the direction (anteroposterior direction) orthogonal to the axial direction of the photosensitive drums 7. The side plates 21 are arranged on both sides of the process cartridges 5 in the width direction respectively. Each side plate 21 is collectively opposed to the four process cartridges 5, and provided to be slidable between the contact position in contact with the process cartridges 5 and the separate position separating from the process cartridges outward in the width direction. The process cartridges 5 are provided with the coupling covers 24 and the drum support members 58 projecting toward the side plates 21. On the other hand, the slidable side plates 21 are provided with the drum retaining holes 47 engaging with the coupling covers 24 and the drum support members 58.

The side plates 21 are provided with the upstream pressed portions 40 and the downstream pressed portions 44 on the upstream end portions and the downstream end portions in the mounting direction of the tandem type photosensitive unit 3 with respect to the main body casing 2 respectively. The pressing members 55 are provided in the main body casing 2 correspondingly to the upstream pressed portions 40 and the downstream pressed portions 44. When the tandem type photosensitive unit 3 is mounted in the main body casing 2, the pressing members 55 press the upstream pressed portions 40 and the downstream pressed portions 44 inward in the width direction. Thus, the side plates 21 are slid inward in the width direction, and the coupling covers 24 engage with the drum retaining holes 47 of the left side plate 21 while the drum support members 58 engage with the drum retaining holes 47 of the right side plate 21. Consequently, the process cartridges 5 are positioned with respect to the side plates 21. The drum retaining holes 47 are formed at regular intervals (at a constant pitch) in the anteroposterior direction, whereby the plurality of photosensitive drums 7 can be precisely arranged at the constant pitch by positioning the process cartridges 5 with respect to the side plates 21.

The side plates 21 are urged by the coil springs 50 outward in the width direction with respect to the process cartridges 5. When the tandem type photosensitive unit 3 is detached from the main body casing 2, therefore, the side plates 21 are slid in the directions separating from the process cartridges 5, whereby the interval between the side plates 21 exceeds that in the state where the tandem type photosensitive unit 3 is mounted in the main body casing 2. Consequently, the coupling between the side plates 21 and the process cartridges 5 can be canceled. Thus, each process cartridge 5 (each photosensitive drum 7) can be individually (independently) detached from the pair of side plates 21 without detaching the side plates 21 from the tandem type photosensitive unit 3.

The tandem type photosensitive unit 3 is provided with the first guide shaft 37 and the second guide shaft 38 for guiding the sliding of the side plates 21. The first guide shaft 37 and the second guide shaft 38 are inserted into the slidable side plates 21. Thus, the sliding movement of the side plates 21 can be excellently guided by the first guide shaft 37 and the second guide shaft 38, while the side plates 21, the first guide shaft 37 and the second guide shaft 38 can be relatively positioned in the anteroposterior direction.

The tandem type photosensitive unit 3 includes the unit support frame 20. The unit support frame 20 has the support grooves 35 receiving the coupling covers 24 and the drum support members 58 of the process cartridges 5, correspondingly to the process cartridges 5 respectively. The coupling covers 24 and the drum support members 58 of the process cartridges 5 are received in the support grooves 35 respectively, whereby the four process cartridges 5 are collectively supported by the unit support frame 20. Therefore, each process cartridge 5 can be prevented from displacement when the coupling between each process cartridge 5 and the side plates 21 is canceled.

The coupling covers 24 are arranged on the axes of the photosensitive drums 7. When the driving force is input in the coupling covers 24 and the photosensitive drums 7 are rotationally driven around the axes, therefore, the photosensitive drums 7 (the process cartridges 5) are not misregistered. Therefore, the photosensitive drums 7 can be kept in states precisely positioned with respect to the side plates 21.

The upstream pressed portions 40 project outward beyond the downstream pressed portions 44 in the width direction.

The pressing members 55 pressing the downstream pressed portions 44 are provided on positions contactable with the downstream pressed portions 44 in the state where the tandem type photosensitive unit 3 is mounted in the main body casing 2. The pressing members 55 pressing the upstream pressed portions 40 are provided on positions contactable with the upstream pressed portions 40 in the state where the tandem type photosensitive unit 3 is mounted in the main body casing 2. When the tandem type photosensitive unit 3 is mounted in the main body casing 2, therefore, the upstream pressed portions 40 and the downstream pressed portions 44 are simultaneously pressed by the pressing members 55. Therefore, the side plates 21 can be moved inward in the width direction in the state kept parallel to the arrangement direction of the tandem type photosensitive unit 3. Consequently, the side plates 21 can be more smoothly slid inward in the width direction.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. A tandem type photosensitive unit comprising:

a plurality of drum retaining units arrayed in line in an arraying direction, each drum retaining unit retains a photosensitive drum having an axis which extends in an axial direction perpendicular to the arraying direction; and a pair of side plates, wherein one side plate of the pair of side plates is arranged on one side of the drum retaining units and another side plate of the pair of side plates is arranged on another side of the drum retaining units in the axial direction and wherein the pair of side plates are opposed to the drum retaining units, wherein at least one of the side plates is provided to be slidable in the axial direction.

2. The tandem type photosensitive unit according to claim 1, further comprising a guide member for guiding sliding movement of the slidable side plate.

3. The tandem type photosensitive unit according to claim 2, wherein the guide member is a guide shaft extending in the axial direction to be inserted into the slidable side plate.

4. The tandem type photosensitive unit according to claim 1, further comprising a unit support frame supporting the drum retaining units and having support grooves correspondingly to the drum retaining units, wherein each support groove receives prescribed portions of the drum retaining unit.

5. The tandem type photosensitive unit according to claim 1, wherein the slidable side plate is slidable between contact positions in contact with the drum retaining units and separate positions separating from the drum retaining units outward in the axial direction, the drum retaining units are provided with projections projecting toward the side plates, and the slidable side plate is provided with positioning portions engaging with the projections for positioning the drum retaining units respectively on the contact positions.

6. The tandem type photosensitive unit according to claim 5, wherein the projections are driving force input portions arranged on the axes of the photosensitive drums for inputting driving force into the photosensitive drums.

7. The tandem type photosensitive unit according to claim 1, further comprising an urging member urging the slidable side plate outward in the axial direction.

8. The tandem type photosensitive unit according to claim 1, wherein the slidable side plate is provided with an upstream pressured portion and a downstream pressured portion receiving pressing force for sliding the slidable side plate inward in the axial direction on one end portion and another end portion in the arraying direction respectively, and the upstream pressured portion project outward in the axial direction beyond the downstream pressured portion.

9. An image forming apparatus comprising:

an apparatus body; and a tandem type photosensitive unit detachably mounted on the apparatus body;

wherein the tandem type photosensitive unit includes a plurality of drum retaining units arrayed in line in an arraying direction, and a pair of side plates, wherein one side plate of the pair of side plates is arranged on one side of the drum retaining units and another side plate of the pair of side plates is arranged on another side of the drum retaining units in an axial direction perpendicular to the arraying direction and wherein the pair of side plates are opposed to the drum retaining units, each drum retaining unit retains a photosensitive drum having an axis which extends in the axial direction, and the interval between the side plates in a state where the tandem type photosensitive unit is detached from the apparatus body and where the pair of side plates are attached to the tandem type photosensitive unit is greater than the interval between the side plates in a state where the tandem type photosensitive unit is mounted on the apparatus body.

10. The image forming apparatus according to claim 9, wherein at least one of the side plates is provided to be slidable in the axial direction.

11. The image forming apparatus according to claim 10, wherein the tandem type photosensitive unit further includes a guide member for guiding sliding movement of the slidable side plate.

12. The image forming apparatus according to claim 11, wherein the guide member is a guide shaft extending in the axial direction to be inserted into the slidable side plate.

13. The image forming apparatus according to claim 9, wherein the tandem type photosensitive unit further includes a unit support frame supporting the drum retaining units and having support grooves correspondingly to the drum retaining units, and each support groove receives prescribed portions of the drum retaining unit.

14. The image forming apparatus according to claim 9, wherein the slidable side plate is slidable between contact positions in contact with the drum retaining units and separate positions separating from the drum retaining units outward in the axial direction, the drum retaining units are provided with projections projecting toward the side plates, and the slidable side plate is provided with positioning portions engaging with the projections for positioning the drum retaining units respectively on the contact positions.

15. The image forming apparatus according to claim 14, wherein the projections are driving force input portions arranged on the axes of the photosensitive drums for inputting driving force into the photosensitive drums.

16. The image forming apparatus according to claim 9, wherein the tandem type photosensitive unit further includes an urging member urging the slidable side plate outward in the axial direction.

17. The image forming apparatus according to claim 9, wherein the apparatus body includes a pressing member pressing at least one of the pair of side plates inward in the axial direction in a state where the tandem type photosensitive unit is mounted on the apparatus body.

18. The image forming apparatus according to claim 17, wherein the slidable side plate is provided with an upstream pressured portion and a downstream pressured portion receiving pressing force for sliding the slidable side plate inward in the axial direction on an upstream end portion and a downstream end portion of a mounting direction of the tandem type photosensitive unit on the apparatus body respectively, the upstream pressured portion project outward in the axial direction beyond the downstream pressured portion, and the pressing members are provided correspondingly to the upstream pressed portion and the downstream pressed portion.

* * * * *